US008474970B2

(12) United States Patent
Yamanobe

(10) Patent No.: US 8,474,970 B2
(45) Date of Patent: Jul. 2, 2013

(54) RECORDING MEDIUM CONVEYANCE METHOD AND APPARATUS, AND IMAGE FORMING APPARATUS

(75) Inventor: Jun Yamanobe, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 254 days.

(21) Appl. No.: 12/979,083

(22) Filed: Dec. 27, 2010

(65) Prior Publication Data

US 2011/0157289 A1 Jun. 30, 2011

(30) Foreign Application Priority Data

Dec. 28, 2009 (JP) ..... 2009-297878

(51) Int. Cl.
*B41J 2/01* (2006.01)
*B41J 29/38* (2006.01)

(52) U.S. Cl.
USPC ..... 347/104; 347/17

(58) Field of Classification Search
USPC ..... 347/104
See application file for complete search history.

(56) References Cited

U.S. PATENT DOCUMENTS 6,550,907 B2 * 4/2003 Uchida ..... 347/104
2006/0164487 A1 * 7/2006 Kadomatsu et al. ..... 347/102

FOREIGN PATENT DOCUMENTS

JP 2004-238111 A 8/2004

* cited by examiner

*Primary Examiner* — Omar Rojas
(74) *Attorney, Agent, or Firm* — Birch, Stewart, Kolasch & Birch, LLP

(57) ABSTRACT

The recording medium conveyance method of conveying a cut sheet of a recording medium, includes the steps of: holding the cut sheet on a circumferential surface of a conveyance body and conveying the cut sheet in a conveyance direction by rotating the conveyance body, the conveyance body being one of a drum and a belt, a back surface of the cut sheet being in contact with the circumferential surface of the conveyance body; and pressing a pressing member to a front surface of the cut sheet held on the circumferential surface of the conveyance body, to apply pressing force to the cut sheet to make the cut sheet close contact with the circumferential surface of the conveyance body, while controlling the pressing force so as to decrease the pressing force from a leading end of the cut sheet toward a trailing end of the cut sheet in terms of the conveyance direction.

16 Claims, 10 Drawing Sheets

RECORDING MEDIUM CONVEYANCE METHOD AND APPARATUS, AND IMAGE FORMING APPARATUS

BACKGROUND OF THE INVENTION

1. Field of the Invention

The present invention relates to an image forming method and apparatus and an image forming apparatus, and more particularly to a recording medium conveyance method and apparatus and an image forming apparatus in which cut sheets of recording media are conveyed while being held by attraction on a circumferential surface of a rotating drum or belt.

2. Description of the Related Art

In an inkjet printer recording an image by an inkjet method, the distance from the paper surface to the inkjet head is the distance over which the ink droplets are thrown, which may be referred to as the "throw distance". From the viewpoint of paper conveyance, a long throw distance is desirable in order to avoid contact between the paper and the inkjet head due to cockling of the paper, or the like. On the other hand, as the throw distance becomes longer, so the landing position displacement of the ink droplets on the paper due to ejection direction defects can become greater, and hence there is a problem in that the image quality falls. Consequently, in order to record an image at high quality, it is necessary to maintain the distance from the surface of the paper to the inkjet head at a prescribed distance or less (e.g., approximately 1 mm or less).

In order to keep the distance from the paper surface to the inkjet head at the prescribed distance or less, it is necessary to hold the paper during conveyance, and this is an indispensable condition in the case of high-speed printing in particular. As conveyance mechanisms for holding and conveying paper, in the related art, there are a method in which paper is conveyed by being held by attraction (e.g., suction, electrostatic attraction, or the like) onto a belt (a so-called belt conveyance method) and a method in which paper is conveyed by being held by attraction (e.g., suction, electrostatic attraction, or the like) onto a drum (a so-called drum conveyance method).

Japanese Patent Application Publication No. 2004-238111 discloses an image forming apparatus conveying paper on a belt, in which the paper is closely fixed onto a surface of the belt and floating up of the paper is prevented, by pressing the paper with a roller while the paper is being held on the belt by electrostatic attraction.

However, if paper is pressed with a roller, then if undulations have occurred in the paper due to cockling, these undulations are pushed toward the trailing end of the paper in terms of the conveyance direction and creases occur in the trailing end portion of the paper in the conveyance direction.

SUMMARY OF THE INVENTION

The present invention has been contrived in view of these circumstances, an object thereof being to provide a recording medium conveyance method and apparatus, and an image forming apparatus, in which a recording medium can be conveyed without the occurrence of creases.

In order to attain the aforementioned object, the present invention is directed to a recording medium conveyance method of conveying a cut sheet of a recording medium, the method comprising the steps of: holding the cut sheet on a circumferential surface of a conveyance body and conveying the cut sheet in a conveyance direction by rotating the conveyance body, the conveyance body being one of a drum and a belt, a back surface of the cut sheet being in contact with the circumferential surface of the conveyance body; and pressing a pressing member to a front surface of the cut sheet held on the circumferential surface of the conveyance body, to apply pressing force to the cut sheet to make the cut sheet close contact with the circumferential surface of the conveyance body, while controlling the pressing force so as to decrease the pressing force from a leading end of the cut sheet toward a trailing end of the cut sheet in terms of the conveyance direction.

According to this aspect of the present invention, when the pressing member is abutted and pressed against the front surface of the cut sheet of recording medium held and conveyed on the rotating drum or belt and the recording medium is thereby caused to make close contact with the circumferential surface of the drum or belt, the recording medium is pressed by the pressing member while controlling the pressing force so as to become weaker from the leading end of the cut sheet to the trailing end of the cut sheet in the conveyance direction of the recording medium. By controlling the pressing force in this way, it is possible for the recording medium to be passed by the pressing member without any distortion which has been pushed from the leading end of the cut sheet being crushed to form creases in the trailing end portion of the cut sheet. Thus, it is possible to convey the recording medium without the occurrence of creases.

Preferably, the holding step includes the step of applying attractive force to attract the back surface of the cut sheet to the circumferential surface of the conveyance body.

According to this aspect of the present invention, the recording medium is conveyed with the back surface of the recording medium being attracted and held onto the circumferential surface of the drum or belt. Thereby, more stable conveyance is possible.

Preferably, the attractive force is controlled so as to increase the attractive force over time from a start of the pressing by the pressing member.

According to this aspect of the present invention, the attractive force applied to the recording medium increases over time from the start of pressing on the recording medium by the pressing member. In other words, the attractive force is weaker at the start of pressing by the pressing member and becomes stronger as pressing progresses (as the location being pressed by the pressing member moves toward the trailing end of the cut sheet recording medium). By controlling the attractive force in this way, it is possible to convey the recording medium without the occurrence of creasing or floating up. More specifically, if the attractive force applied to the recording medium is set to be too strong, then creasing is liable to arise in the trailing end portion of the recording medium in the conveyance direction, and conversely if the attractive force is set to be too weak, then floating is liable to occur in the trailing end portion of the recording medium in the conveyance direction. Therefore, by making the attractive force weak at the start of pressing by the pressing member and then strengthening the attractive force as pressing progresses, it is possible to convey the recording medium without the occurrence of creasing or floating up.

It is also preferable that the attractive force is controlled so as to increase the attractive force from the leading end of the cut sheet toward the trailing end of the cut sheet.

According to this aspect of the present invention, the attractive force is controlled in such a manner that the attractive force increases from the leading end of the cut sheet to the trailing end of the cut sheet, in the conveyance direction of the recording medium. More specifically, the attractive force is set so as to be weaker on the leading end of the cut sheet and become stronger toward the trailing end of the cut sheet, in terms of the conveyance direction of the recording medium. By controlling the attractive force in this way, it is possible to prevent the occurrence of creases more effectively.

Preferably, the pressing member applies the pressing force increasing from a center of the cut sheet toward each widthwise end of the cut sheet in a direction perpendicular to the conveyance direction.

According to this aspect of the present invention, the pressing member presses the recording medium in such a manner that the distribution of pressing force in the direction perpendicular to the conveyance direction of the recording medium increases from the center of the cut sheet recording medium to each of the widthwise ends of the cut sheet recording medium. In other words, the pressing force is set to be weaker in the center of the cut sheet and become stronger toward each of the widthwise ends of the cut sheet. By setting the pressing force in this way, it is possible to expel creases in the recording medium, to the widthwise ends of the cut sheet, and therefore the occurrence of creases can be prevented even more effectively.

Preferably, the pressing force is set in accordance with a type of the recording medium.

According to this aspect of the present invention, the pressing force applied to the recording medium is set in accordance with the type of recording medium. By this means, it is possible to press the medium with a suitable pressing force in accordance with the type of recording medium (thickness, size, material, etc.), and therefore the occurrence of creases can be prevented even more effectively.

In order to attain the aforementioned object, the present invention is also directed to a recording medium conveyance apparatus, comprising: a conveyance device which holds a cut sheet of a recording medium on a circumferential surface of a conveyance body and conveys the cut sheet in a conveyance direction by rotating the conveyance body, the conveyance body being one of a drum and a belt, a back surface of the cut sheet being in contact with the circumferential surface of the conveyance body; a pressing device which presses a pressing member to a front surface of the cut sheet held on the circumferential surface of the conveyance body, to apply pressing force to the cut sheet to make the cut sheet close contact with the circumferential surface of the conveyance body; and a pressing force control device which controls the pressing force so as to decrease the pressing force from a leading end of the cut sheet toward a trailing end of the cut sheet in terms of the conveyance direction.

According to this aspect of the present invention, when the pressing member is abutted and pressed against the surface of the cut sheet recording medium held and conveyed on the rotating drum or belt and the recording medium is thereby caused to make close contact with the circumferential surface of the drum or belt, the recording medium is pressed by the pressing member while controlling the pressing force so as to become weaker from the leading end of the cut sheet to the trailing end of the cut sheet in the conveyance direction of the recording medium. By controlling the pressing force in this way, it is possible for the recording medium to be passed by the pressing member without any distortion which has been pushed from the leading end portion of the cut sheet being crushed to form creases in the trailing end portion of the cut sheet. Thus, it is possible to convey the recording medium without the occurrence of creases.

Preferably, the conveyance device includes an attraction device which applies attractive force to attract the back surface of the cut sheet to the circumferential surface of the conveyance body.

According to this aspect of the present invention, the recording medium is conveyed with the back surface of the recording medium being attracted and held onto the circumferential surface of the drum or belt. Thereby, more stable conveyance is possible.

Preferably, the recording medium conveyance apparatus further comprises an attractive force control device which controls the attractive force so as to increase the attractive force over time from a start of the pressing member to press the front surface of the cut sheet.

According to this aspect of the present invention, the attractive force acting on the recording medium increases over time from the start of pressing on the recording medium by the pressing member. In other words, the attractive force is weaker at the start of pressing by the pressing member and becomes stronger as pressing progresses. By controlling the attractive force in this way, it is possible to convey the recording medium without the occurrence of creasing or floating up.

It is also preferable that the recording medium conveyance apparatus further comprises an attractive force control device which controls the attractive force so as to increase the attractive force from the leading end of the cut sheet toward the trailing end of the cut sheet.

According to this aspect of the present invention, the attractive force is controlled in such a manner that the attractive force increases from the leading end of the cut sheet toward the trailing end of the cut sheet. More specifically, the attractive force is set so as to be weaker on the leading end of the cut sheet and become stronger toward the trailing end of the cut sheet, in terms of the conveyance direction of the recording medium. By controlling the attractive force in this way, it is possible to prevent the occurrence of creases more effectively.

Preferably, the pressing member applies the pressing force increasing from a center of the cut sheet toward each widthwise end of the cut sheet in a direction perpendicular to the conveyance direction.

According to this aspect of the present invention, the pressing member presses the recording medium in such a manner that the distribution of pressing force in the direction perpendicular to the conveyance direction of the recording medium increases from the center of the cut sheet recording medium to each of the widthwise ends of the cut sheet recording medium. In other words, the pressing force is set to be weaker in the center of the cut sheet and become stronger toward each of the widthwise ends of the cut sheet. By setting the pressing force in this way, it is possible to expel creases in the recording medium, to the widthwise ends of the cut sheet, and therefore the occurrence of creases can be prevented even more effectively.

Preferably, the pressing force control device includes spacer members which are arranged at both widthwise ends of the conveyance body along a circumferential direction of the conveyance body, each of the spacer members having height from the circumferential surface of the conveyance body increasing from a position corresponding to the leading end of the cut sheet toward a position corresponding to the trailing end of the cut sheet.

According to this aspect of the present invention, the pressing force control device is constituted of the spacer members, which are disposed along the circumferential direction of the drum or belt at both widthwise ends of the drum or belt. In conjunction with travel of the drum or belt, the pressing member is separated, either smoothly or stepwise, from the circumferential surface of the drum or belt, by means of the spacer members. Thereby, the pressing force applied to the recording medium by the pressing member is controlled. By composing the pressing force control device as the spacer members in this way, it is possible to control the pressing force accurately by means of a simple composition.

Preferably, the spacer members are arranged to the conveyance body exchangeably in accordance with a type of the recording medium, so as to set the pressing force in accordance with the type of the recording medium.

According to this aspect of the present invention, it is possible to adjust the pressing force applied to the recording medium in accordance with the type of recording medium, by exchanging the spacer members in accordance with the type of recording medium (thickness, size, material, etc.). Thereby, it is possible to press the medium with a suitable pressing force in accordance with the type of recording medium, and thus the occurrence of creases can be prevented even more effectively.

Preferably, the pressing member includes a roller which is pressed toward the circumferential surface of the conveyance body.

According to this aspect of the present invention, the pressing member is constituted of the roller which is pressed toward the circumferential surface of the belt or drum. The pressing member can be constituted of a plate member, or the like, which is pressed toward the circumferential surface of the belt or drum, but if constituted as a roller, it is possible to prevent rubbing, or the like, of the surface of the recording medium, and stable conveyance is possible.

In order to attain the aforementioned object, the present invention is also directed to an image forming apparatus, comprising: the above-described recording medium conveyance apparatus; and a droplet ejection device which ejects droplets of liquid to the recording medium conveyed by the recording medium conveyance apparatus.

According to this aspect of the present invention, image recording is carried out by ejecting liquid droplets to a recording medium conveyed by the recording medium conveyance apparatus. Droplet deposition onto the recording medium is performed after the recording medium has been pressed by the pressing member. By conveying the recording medium with the recording medium conveyance apparatus, it is possible to convey the recording medium without the occurrence of creases or floating, and therefore images of high quality can be recorded.

Preferably, the image forming apparatus further comprises a treatment liquid deposition device which deposits treatment liquid onto the recording medium, wherein the recording medium on which the treatment liquid has been deposited by the treatment liquid deposition device is conveyed by the recording medium conveyance device.

According to this aspect of the present invention, the recording medium on which the treatment liquid has been deposited in advance and then dried is conveyed by the recording medium conveyance apparatus. The recording medium on which the treatment liquid has been deposited previously may produce small undulations, due to cockling and the like, but by conveying the recording medium with the recording medium conveyance apparatus, it is possible to convey the medium without the occurrence of creases or floating, and therefore images of high quality can be recorded.

According to the present invention it is possible to convey a recording medium without the occurrence of creases.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Printer

Figure 1:
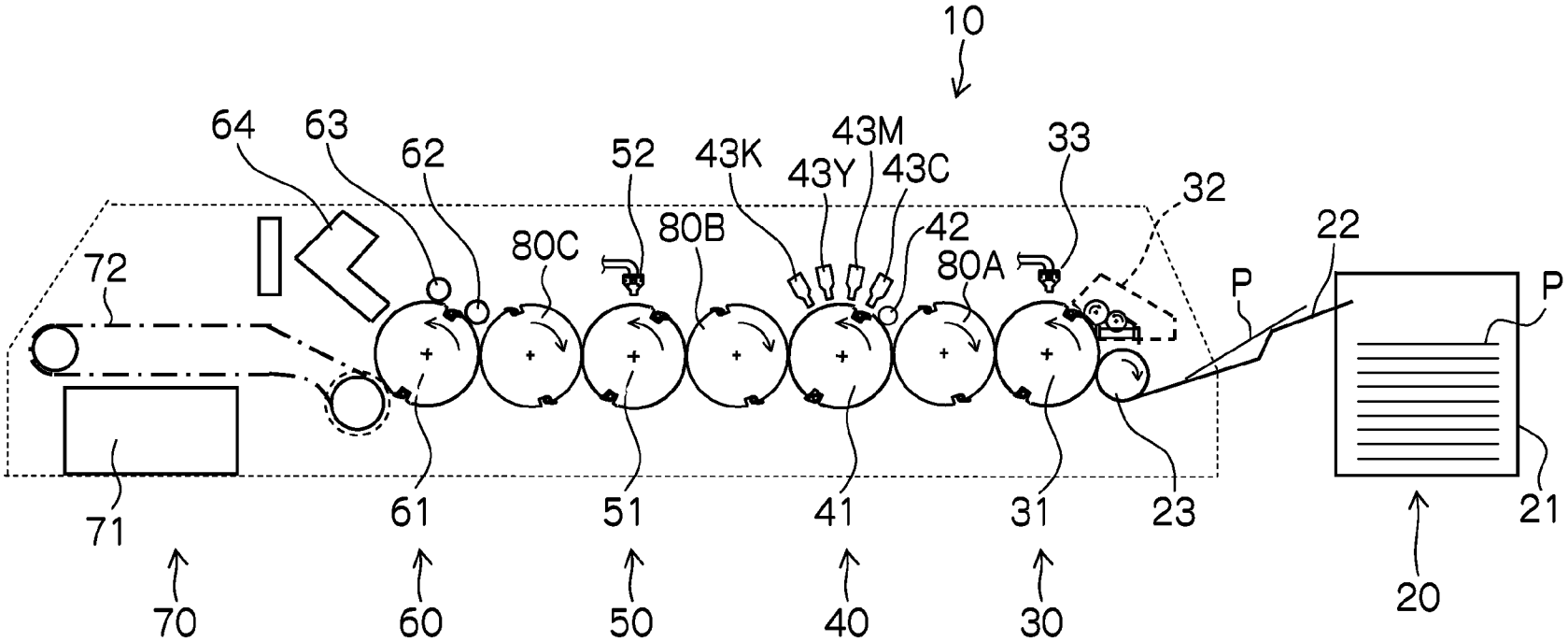
FIG. 1 is a general schematic drawing of an inkjet printer.

FIG. 1 is general schematic drawing showing an inkjet printer according to an embodiment of the present invention.

The inkjet printer 10 can print a color image by ejecting and depositing droplets of inks of four colors of cyan (C), magenta (M), yellow (Y) and black (K) onto cut sheet paper P by an inkjet method. The inkjet printer 10 includes: a paper supply unit 20, which supplies paper P; a treatment liquid deposition unit 30, which deposits a prescribed treatment liquid onto a printing surface of the paper P; an image formation unit 40, which forms a color image by ejecting droplets of ink of the respective colors of C, M, Y and K to the printing surface of the paper P; a drying unit 50, which dries the ink droplets that have been deposited on the paper P; a fixing unit 60, which fixes the image formed on the paper P; and a recovery unit 70, which recovers the paper P after printing.

The treatment liquid deposition unit 30, the image formation unit 40, the drying unit 50 and the fixing unit 60 each have conveyance drums 31, 41, 51 and 61 as conveyance devices for the paper P. The paper P wraps about the circumferential surface of each of the conveyance drums 31, 41, 51 and 61, and is thereby conveyed through the treatment liquid drying unit 30, the image formation unit 40, the drying unit 50 and the fixing unit 60.

Moreover, intermediate conveyance drums 80A, 80B and 80C are disposed as conveyance devices for the paper P between the treatment liquid deposition unit 30 and the image formation unit 40, the image formation unit 40 and the drying unit 50, and the drying unit 50 and the fixing unit 60, respectively. The paper P is conveyed between the respective units by wrapping about the circumferential surface of each of the intermediate conveyance drums 80A, 80B and 80C.

Grippers are arranged respectively in two positions of the circumferential surface of each of the conveyance drums 31, 41, 51 and 61 and the intermediate conveyance drums 80A, 80B and 80C. The paper P is wrapped about the circumferential surface of the drum while the leading end portion of the sheet of paper P is gripped by the grippers.

Furthermore, a plurality of suction holes are formed on each of the conveyance drums 31, 41, 51 and 61. The back surface of the paper P is sucked through the suction holes, and the paper P is thereby held on the circumferential surface by suction.

The paper P wraps about the conveyance drums 31, 51, 41 and 61 with the printing surface facing to the outside, and wraps about the intermediate conveyance drums 80A, 80B and 80C with the printing surface facing to the inside.

The paper P supplied from the paper supply unit 20 is transferred to the conveyance drum 31 of the treatment liquid deposition unit 30, and is then transferred from the conveyance drum 31 of the treatment liquid deposition unit 30 to the conveyance drum 41 of the image formation unit 40 through the intermediate conveyance drum 80A. The paper P is transferred from the conveyance drum 41 of the image formation unit 40 to the conveyance drum 51 of the drying unit 50 through the intermediate conveyance drum 80B, and is transferred from the conveyance drum 51 of the drying unit 50 to the conveyance drum 61 of the fixing unit 60 through the intermediate conveyance drum 80C. The paper is then transferred from the conveyance drum 61 of the fixing unit 60 to the recovery unit 70. While passing through this series of conveyance steps, prescribed processes are carried out onto the paper P in the respective units and an image is formed on the printing surface of the paper P.

The compositions of the respective units of the inkjet printer 10 according to the present embodiment are described in detail below.

<Paper Supply Unit>

The paper supply unit 20 includes a paper supply device 21, a paper supply tray 22 and a transfer drum 23, and supplies cut sheets of paper (for example, coated paper) P continuously, one sheet at a time, to the treatment liquid deposition unit 30.

The paper supply device 21 successively supplies the stacked sheets of paper P stored in a magazine (not shown), one sheet at a time, to the paper supply tray 22.

The paper supply tray 22 outputs the paper P supplied from the paper supply device 21, to the transfer drum 23.

The transfer drum 23 receives the paper P output from the paper supply tray 22, conveys the paper P by the paper P wrapping about the circumferential surface thereof, and then transfers the paper P to the conveyance drum 31 of the treatment liquid deposition unit 30.

<Treatment Liquid Deposition Unit>

The treatment liquid deposition unit 30 deposits a prescribed treatment liquid onto the printing surface of the paper P. The treatment liquid deposition unit 30 includes: the conveyance drum (treatment liquid drum) 31, which conveys the paper P; a treatment liquid deposition device 32, which deposits the prescribed treatment liquid onto the printing surface of the paper P conveyed by the treatment liquid drum 31; and a treatment liquid drying device 33, which dries the solvent component of the treatment liquid that has been deposited on the paper P.

The treatment liquid drum 31 receives the paper P from the transfer drum 23 of the paper supply unit 20 (by gripping the leading end of the sheet of paper P with the gripper), and conveys the paper P by rotating. In this, the treatment liquid drum 31 receives the paper P from the transfer drum 23 of the paper supply unit 20, with the printing surface of the paper P facing to the outside, and conveys the paper P while holding the back surface of the paper P by suction.

The treatment liquid deposition device 32 deposits the treatment liquid having a function of aggregating ink onto the printing surface of the paper P conveyed by the treatment liquid drum 31. In the inkjet printer 10 according to the present embodiment, the treatment liquid deposition device 32 is constituted as a coating device, which applies the treatment liquid to the printing surface of the paper P by abutting and pressing a coating roller bearing the treatment liquid on the circumferential surface thereof against the surface of the paper P. Apart from this, the treatment liquid deposition device 32 can also be constituted of an inkjet head, a sprayer, or the like. An inkjet method has a merit in enabling selective application only onto the ink droplet deposition locations and periphery thereof.

The treatment liquid contains a material having a component that aggregates or increases the viscosity of the coloring material (pigment or dye) in the ink. More specifically, the treatment liquid is one which precipitates or insolubilizes the coloring material in the ink, or a treatment liquid which creates a semi-solid substance (e.g., gel) including the coloring material in the ink, or the like. The method for producing a reaction between the ink and the treatment liquid includes: a method of making an anionic coloring material in the ink react with a cationic component in the treatment liquid; a method of aggregating the pigment by causing breakdown of the dispersion of the pigment in the ink by altering the pH of the ink through mixing the ink with a treatment liquid having the pH different from the pH of the ink; a method of aggregating the pigment by causing breakdown of the dispersion of the pigment in the ink by means of a reaction with a polyvalent metallic salt in the treatment liquid; or the like.

By depositing droplets of the ink after depositing the treatment liquid of this kind, it is possible to suppress landing interference, and high-quality printing can be achieved.

The treatment liquid drying device 33 dries the solvent component of the treatment liquid deposited by the treatment liquid deposition device 32. In the inkjet printer 10 according to the present embodiment, the treatment liquid drying device 33 is constituted of a dryer, and a hot air flow is blown onto the surface of the paper P conveyed by the treatment liquid drum 31, thereby drying the solvent component in the treatment liquid.

According to the treatment liquid deposition unit 30 composed as described above, the paper P is conveyed by the treatment liquid drum 31 and deposition and drying of the treatment liquid are carried out in the course of this conveyance. In other words, firstly, the treatment liquid is deposited onto the printing surface by the treatment liquid deposition device 32, and then the hot air flow is blown onto the printing surface by the treatment liquid drying device 33, thereby drying the solvent component of the deposited treatment liquid.

The paper P on which the solvent component of the treatment liquid has been dried is then transferred from the treatment liquid drum 31 to the intermediate conveyance drum 80A and is conveyed to the image formation unit 40 by the intermediate conveyance drum 80A, and then transferred to the conveyance drum 41 of the image formation unit 40.

<Image Formation Unit>

The image formation unit 40 forms a color image on the printing surface of the paper P by ejecting ink droplets of the respective colors of C, M, Y and K to the printing surface of the paper P. The image formation unit 40 includes: the conveyance drum (image formation drum) 41, which conveys the paper P; a pressing roller 42, which presses the paper P conveyed by the image formation drum 41 against the circumferential surface of the image formation drum 41; and inkjet heads 43C, 43M, 43Y and 43K, which eject ink droplets of the respective colors of C, M, Y and K to the paper P.

The image formation drum 41 receives the paper P from the intermediate conveyance drum 80A (by gripping the leading end of the sheet of paper P with the gripper), and conveys the paper P by rotating. In this, the image formation drum 41 receives the paper P from the intermediate conveyance drum 80A, with the printing surface of the paper P facing to the outside, and conveys the paper P while holding the back surface of the paper P by suction.

The pressing roller 42 has the width (the dimension in the direction perpendicular to the conveyance direction of the paper P) which is substantially the same with the image formation drum 41, and the surface thereof is covered with rubber. The pressing roller 42 is disposed in the vicinity of the paper receiving position of the image formation drum 41 (the position where the image formation drum 41 receives the paper P from the intermediate conveyance drum 80A), and is pressed toward the circumferential surface of the image formation drum 41 with a prescribed pressing force by a pressing mechanism (not shown). The paper P that has been transferred from the intermediate conveyance drum 80A to the image formation drum 41 is pressed against the circumferential surface of the image formation drum 41 by passing the pressing roller 42, and is thereby caused to make close contact with the circumferential surface of the image formation drum 41. The pressing force applied by the pressing roller 42 is controlled by a prescribed control mechanism, and the pressing force is controlled so as to become weaker from the leading end of the sheet of paper P to the trailing end of the sheet of paper P in terms of the direction of conveyance of the paper P. By controlling the pressing force in this way, it is possible to convey the paper P past the pressing roller 42 without any distortion pushed from the leading end portion of the sheet of paper P being crushed to form creases in the trailing end portion of the paper P, and hence the paper P can be conveyed without the occurrence of creasing. This point is described in detail below.

Desirably, the surface of the pressing roller 42 is made of a member having lower surface energy than the recording medium (the paper P in the present embodiment). This is in order that the treatment liquid deposited on the recording medium does not adhere to the pressing roller 42.

The four inkjet heads 43C, 43M, 43Y and 43K are disposed at prescribed intervals apart from each other in positions downstream of the pressing roller 42, and eject ink droplets of the corresponding colors toward the image formation drum 41. Each of the inkjet heads 43C, 43M, 43Y and 43K is constituted of a line head corresponding to the paper width, and ejects ink droplets toward the image formation drum 41 from a nozzle row formed on a nozzle surface.

According to the image formation unit 40 composed as described above, the paper P is conveyed by the image formation drum 41 and nipped by the pressing roller 42 in the course of the conveyance, then ink droplets of the respective colors of C, M, Y and K are ejected to the printing surface of the paper P from the inkjet heads 43C, 43M, 43Y and 43K, and a color image is thereby recorded on the printing surface of the paper P.

In the inkjet printer 10 according to the present embodiment, an aqueous ink in which a thermoplastic resin has been dispersed is used for each color.

The paper P on which the droplets of ink have been ejected and deposited from the inkjet heads 43C, 43M, 43Y and 43K is then transferred to the intermediate conveyance drum 80B from the image formation drum 41, the paper P is conveyed to the drying unit 50 by the intermediate conveyance drum 80B, and is transferred to the conveyance drum 51 of the drying unit 50.

<Drying Unit>

The drying unit 50 dries the liquid component remaining on the paper P after the image formation. The drying unit 50 includes: the conveyance drum (drying drum) 51, which conveys the paper P; and a drying device 52, which carries out a drying process on the paper P conveyed by the drying drum 51.

The drying drum 51 receives the paper P from the intermediate conveyance drum 80B (by gripping the leading end of the sheet of paper P with the gripper), and conveys the paper P by rotating. In this, the drying drum 51 receives the paper P from the intermediate conveyance drum 80B, with the printing surface of the paper P facing to the outside, and conveys the paper P while holding the back surface of the paper P by suction.

The drying device 52 carries a process for evaporating off the liquid component present on the paper. More specifically, when the droplets of ink are deposited on the paper P in the image formation unit 40, the liquid component of the ink and the liquid component of the treatment liquid which have been separated by the aggregating reaction between the treatment liquid and the ink remain on the paper, and therefore the process for evaporating off the liquid component remaining on the paper is carried out. In the inkjet printer 10 according to the present embodiment, the liquid component present on the paper is evaporated off by blowing the hot air flow toward the paper P conveyed by the drying drum 51.

According to the drying unit 50 composed as described above, the paper P is conveyed by the drying drum 51, the hot air flow is blown from the drying device 52 in the course of the conveyance, and the drying process is thereby performed. The paper P that has passed through the drying device 52 is then transferred from the drying drum 51 to the intermediate conveyance drum 80C, conveyed by the intermediate conveyance drum 80C to the fixing unit 60, and transferred to the conveyance drum 61 of the fixing unit 60.

<Fixing Unit>

The fixing unit 60 fixes the image having been formed on the printing surface of the paper P, by applying heat and pressure to the paper P. The fixing unit 60 includes: the conveyance drum (fixing drum) 61, which conveys the paper P; heat rollers 62 and 63 which carry out a heating and pressing process on the paper P conveyed by the fixing drum 61; and an in-line sensor 64, which captures the image formed on the paper P.

The fixing drum 61 receives the paper P from the intermediate conveyance drum 80C (by gripping the leading end of the sheet of paper P with the gripper), and conveys the paper P by rotating. In this, the fixing drum 61 receives the paper P from the intermediate conveyance drum 80C, with the printing surface of the paper P facing to the outside, and conveys the paper P while holding the back surface of the paper P by suction.

The heat rollers 62 and 63 apply heat and pressure to the ink that has been deposited on the printing surface of the paper P, thereby melt the thermoplastic resin dispersed in the ink to convert the ink into a film, and it is simultaneously possible to correct deformation such as cockling or curl that has occurred in the paper P. The heat rollers 62 and 63 have the widths (the dimensions in the direction perpendicular to the conveyance direction of the paper P) which are substantially the same with the fixing drum 61, and are heated to a prescribed temperature by internally arranged heaters. Furthermore, the heat rollers 62 and 63 are pressed toward the circumferential surface of the fixing drum 61 with a prescribed pressing force by a pressing mechanism (not shown). By passing the heat rollers 62 and 63, the paper P is heated and pressed by the heat rollers 62 and 63.

The in-line sensor 64 is constituted of a CCD line sensor disposed perpendicularly with respect to the conveyance direction of the paper P, and captures an image of the surface of the paper P conveyed by the fixing drum 61. Ejection defects in the inkjet heads 43C, 43M, 43Y and 43K disposed in the image formation unit 40, and the like, are checked on the basis of the image captured by the in-line sensor 64.

According to the fixing unit 60 composed as described above, the paper P is conveyed by the fixing drum 61 and in the course of the conveyance, the heat rollers 62 and 63 are abutted and pressed against the printing surface of the paper P, thereby heating and pressing the paper P. Thereby, the thermoplastic resin dispersed in the ink is melted and the ink is converted into a film. Moreover, simultaneously with this, deformation that has occurred in the paper P is corrected. Furthermore, if necessary, the image having been formed on the printing surface is captured by the in-line sensor 64 and a prescribed examination is carried out.

The paper P that has undergone the fixing process is then transferred from the fixing drum 61 to the recovery unit 70.

<Recovery Unit>

The recovery unit 70 recovers the paper P on which the series of printing processes has been carried out, by stacking the paper on a stacker 71. The recovery unit 70 includes: the stacker 71, which recovers the paper P; and a paper output conveyor 72, which receives the paper P that has undergone the fixing process in the fixing unit 60 from the fixing drum 61, conveys the paper P along a prescribed conveyance path and then outputs the paper P onto the stacker 71.

The paper P that has undergone the fixing process in the fixing unit 60 is transferred from the fixing drum 61 to the paper output conveyor 72, conveyed to the stacker 71 by the paper output conveyor 72, and recovered in the stacker 71.

<Control System>

Figure 2:
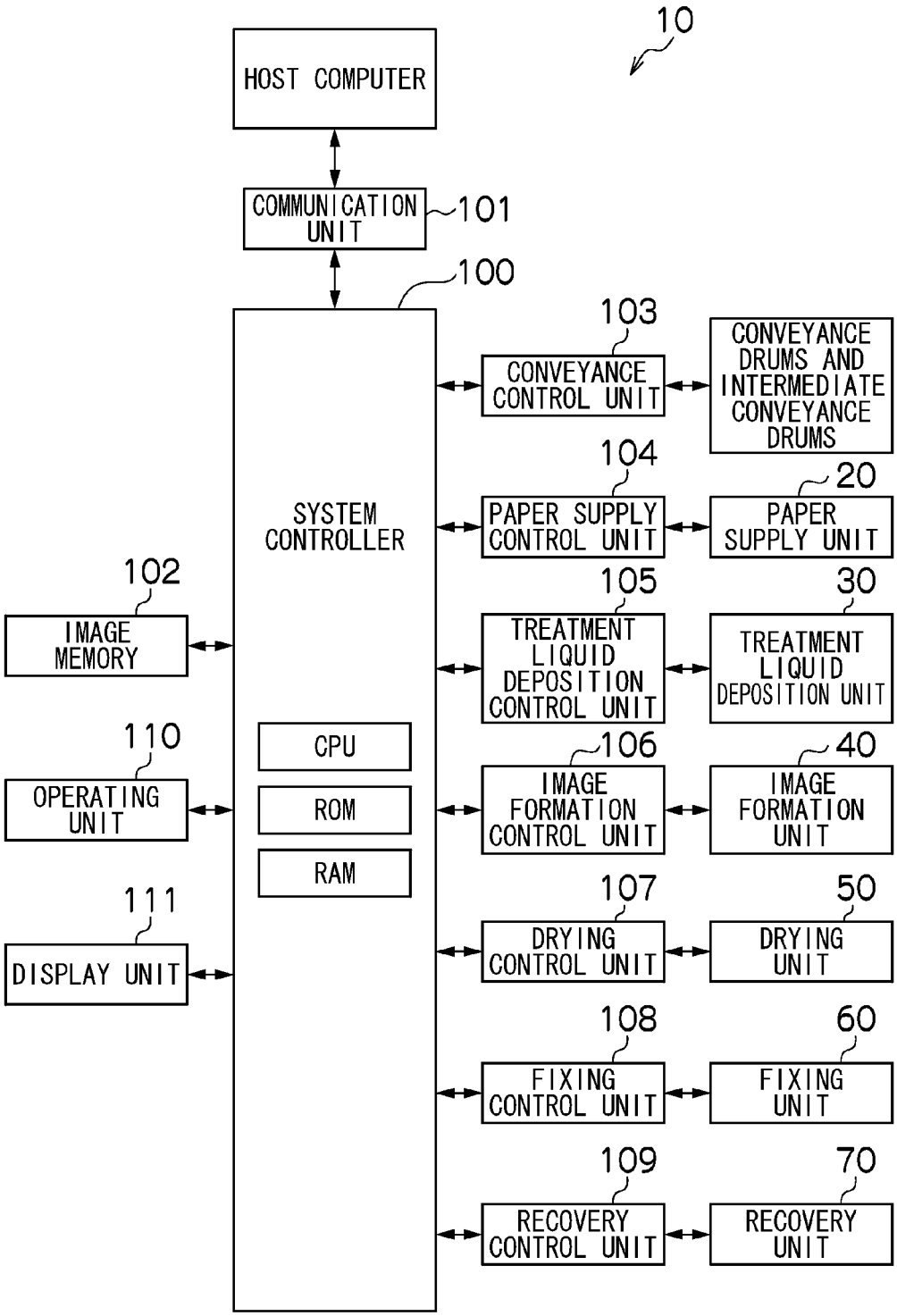
FIG. 2 is a block diagram of a control system of the inkjet printer.

FIG. 2 is a block diagram showing the general composition of the control system of the inkjet printer 10 according to the present embodiment.

As shown in FIG. 2, the inkjet printer 10 includes: a system controller 100, a communication unit 101, an image memory 102, a conveyance control unit 103, a paper supply control unit 104, a treatment liquid deposition control unit 105, an image formation control unit 106, a drying control unit 107, a fixing control unit 108, a recovery control unit 109, an operating unit 110, a display unit 111, and the like.

The system controller 100 functions as a control device which implements overall control of the various units of the inkjet printer 10, as well as functioning as a calculation device which carries out various calculation processes (image processing, examination processes of various kinds based on outputs from the in-line sensor 64, and so on). The system controller 100 includes a CPU, ROM, RAM, and the like, and operates in accordance with a prescribed control program. A control program which is executed by the system controller 100 and various data required for control purposes are stored in the ROM.

The communication unit 101 includes a prescribed communication interface and sends and receives data to and from a host computer connected to the communication interface.

The image memory 102 functions as a temporary storage device for various data including image data, and the data is read from and written to the memory through the system controller 100. The image data read in from the host computer through the communication unit 101 is stored in the image memory 102.

The conveyance control unit 103 controls the driving of the conveyance drums 31, 41, 51 and 61, which are the respective conveyance devices for the paper P in the treatment liquid deposition unit 30, the image formation unit 40, the drying unit 50 and the fixing unit 60, and the driving of the intermediate conveyance drums 80A, 80B and 80C. In other words, the conveyance control unit 103 controls the driving of the motors which drive the conveyance drums 31, 41, 51 and 61, as well as controlling the opening and closing of the grippers which are arranged in the conveyance drums 31, 41, 51 and 61. Similarly, the conveyance control unit 103 controls the driving of the motors which drive the intermediate conveyance drums 80A, 80B and 80C, as well as controlling the opening and closing of the grippers which are arranged in the intermediate conveyance drums 80A, 80B and 80C. Furthermore, since the conveyance drums 31, 41, 51 and 61 have the mechanisms which hold the paper P on the circumferential surfaces thereof by attraction, the conveyance control unit 103 also controls the driving of the attraction holding mechanisms (in the present embodiment, the paper P is suctioned, and the driving of a vacuum pumps which serve as the negative pressure generating devices are controlled). The driving of the conveyance drums 31, 41, 51 and 61 and the intermediate conveyance drums 80A, 80B and 80C is controlled in accordance with instructions from the system controller 100.

The paper supply control unit 104 controls the driving of the respective units (paper supply device 21, transfer drum 23, and the like) which constitute the paper supply unit 20 in accordance with instructions from the system controller 100.

The treatment liquid deposition control unit 105 controls the driving of the respective units (treatment liquid deposition device 32, treatment liquid drying device 33, and the like) which constitute the treatment liquid deposition unit 30 in accordance with instructions from the system controller 100.

The image formation control unit 106 controls the driving of the respective units (pressing roller 42, inkjet heads 43C, 43M, 43Y, 43K, and the like) which constitute the image formation unit 40 in accordance with instructions from the system controller 100.

The drying control unit 107 controls the driving of the respective units (drying device 52, and the like) which constitute the drying unit 50 in accordance with instructions from the system controller 100.

The fixing control unit 108 controls the driving of the respective units (heat rollers 62 and 63, in-line sensor 64, and the like) which constitute the fixing unit 60 in accordance with instructions from the system controller 100.

The recovery control unit 109 controls the driving of the respective units (paper output conveyor 72, and the like) which constitute the recovery unit 70 in accordance with instructions from the system controller 100.

The operating unit 110 includes prescribed operating devices (for example, operating buttons, keyboard, touch panel, and the like), and outputs operating information input though the operating devices to the system controller 100. The system controller 100 executes various processing in accordance with operational information input from the operating unit 110.

The display unit 111 includes a prescribed display device (for example, an LCD panel, or the like), and the display unit 111 causes the display device to show prescribed information in accordance with instructions from the system controller 100.

As stated previously, image data to be recorded on the paper P is read into the inkjet printer 10 from the host computer through the communication unit 101, and the image data is stored in the image memory 102. The system controller 100 generates dot data by applying a prescribed signal processing to the image data stored in the image memory 102, and records an image represented by the image data on the paper P by controlling the driving of the inkjet heads 43C, 43M, 43Y and 43K.

In general, the dot data is generated by subjecting the image data to color conversion processing and halftone processing. The color conversion processing is processing for converting image data represented by an sRGB system (e.g., 8-bit RGB image data) for instance, into image data of the respective colors of ink used by the inkjet printer 10. The halftone processing is processing for converting the color data of the respective colors generated by the color conversion processing into dot data of respective colors by error diffusion processing, or the like.

The system controller 100 generates dot data of the respective colors by applying the color conversion processing and the halftone processing to the image data. An image represented by the image data is recorded on the paper by controlling the driving of the corresponding inkjet heads in accordance with the dot data for the respective colors thus generated.

<Printing Operation>

A printing operation of the inkjet printer 10 described above is explained below.

The paper supply device 21 supplies sheets of paper P stored in stack in the magazine (not shown), successively one sheet at a time from the top, to the paper supply tray 22. The paper P supplied to the paper supply tray 22 is transferred to the treatment liquid drum 31 of the treatment liquid deposition unit 30 through the transfer drum 23.

In the course of conveyance by the treatment liquid drum 31, the treatment liquid is deposited onto the paper P that has been transferred to the treatment liquid drum 31 and the treatment liquid is dried. In other words, firstly, the treatment liquid is deposited onto the printing surface of the paper P by the treatment liquid deposition device 32, and then the solvent component of the deposited treatment liquid is dried by the treatment liquid drying device 33.

The paper P on which the treatment liquid has been deposited and dried is then transferred from the treatment liquid drum 31 to the intermediate conveyance drum 80A and is conveyed to the image formation unit 40 by the intermediate conveyance drum 80A, and then transferred to the conveyance drum 41 of the image formation unit 40.

The paper P transferred to the image formation drum 41 is firstly nipped by the pressing roller 42, whereupon ink droplets of respective colors of C, M, Y and K are ejected from the inkjet heads 43C, 43M, 43Y and 43K and deposited onto the printing surface of the paper P, thereby forming an image on the printing surface.

The paper P on which the image has been formed is transferred from the image formation drum 41 to the intermediate conveyance drum 80B and is conveyed to the drying unit 50 by the intermediate conveyance drum 80B, and then transferred to the drying drum 51 of the drying unit 50.

During the course of conveyance by the drying drum 51, a hot air flow is blown from the drying device 52 onto the paper P that has been transferred to the drying drum 51, thereby drying the liquid component remaining on the printing surface of the paper P.

The paper P that has undergone the drying process is transferred from the drying drum 51 to the intermediate conveyance drum 80C, conveyed by the intermediate conveyance drum 80C to the fixing unit 60, and transferred to the fixing drum 61 of the fixing unit 60.

During the course of conveyance by the fixing drum 61, the paper P that has been transferred to the fixing drum 61 is heated and pressed by the heat rollers 62 and 63, and the image formed on the printing surface of the paper P is fixed.

The paper P on which the image has been fixed by the fixing unit 60 is transferred from the fixing drum 61 to the paper output conveyor 72 of the recovery unit 70.

The paper P transferred to the paper output conveyor 72 is conveyed to the stacker 71 by the paper output conveyor 72 and output into the stacker 71.

As described above, in the inkjet printer 10 according to the present embodiment, the paper P is conveyed on drums and during the course of this conveyance, respective processes of treatment liquid deposition and drying, ejection of ink droplets, drying, and fixing are carried out, thereby printing one sheet of paper P.

Detailed Description of Paper Conveyance System in Image Formation Unit

First Embodiment

As described above, in the image formation unit 40, the paper P is conveyed by being attracted to and held on the circumferential surface of the image formation drum 41. In the inkjet printer 10 according to the present embodiment, in order to prevent floating up of the paper P conveyed by the image formation drum 41, the front surface of the paper P is pressed by the pressing roller 42 and the paper P is thereby caused to make close contact with the circumferential surface of the image formation drum 41.

The pressing roller 42 is disposed so as to press toward the circumferential surface of the image formation drum 41, and the paper P is pressed by the pressing roller 42 successively from the leading end of the sheet of paper P in the conveyance direction as the paper P passes by the pressing roller 42, whereby the paper P is caused to make close contact with the image formation drum 41.

However, if undulations have occurred in the paper P when the paper P is pressed by the pressing roller 42 in this way, these undulations are pushed toward the trailing end of the sheet of paper P in the conveyance direction, and hence there is a defect in that creases occur in the trailing end portion of the sheet of paper P in the conveyance direction.

Hence, in the inkjet printer 10 according to the present embodiment, the pressing force applied to the paper P by the pressing roller 42 is controlled to prevent the occurrence of creases. More specifically, the pressing force is controlled in such a manner that the pressing force decreases relatively from the leading end of the sheet of paper P to the trailing end of the sheet of paper P in terms of the conveyance direction of the paper P (namely, the pressing force is controlled in such a manner that the pressing force applied to the paper P is higher on the leading end of the sheet of paper P in the conveyance direction of the paper P and becomes weaker toward the trailing end of the sheet of paper P in the conveyance direction of the paper P).

By controlling the pressing force in this way, it is possible to convey the paper P past the pressing roller 42 without any distortion pushed from the leading end of the sheet of paper P in the conveyance direction of the paper P being crushed to form creases in the trailing end portion of the sheet of paper P, and hence the paper P can be caused to make close contact with the circumferential surface of the image formation drum 41 without the occurrence of creasing.

Figure 3:
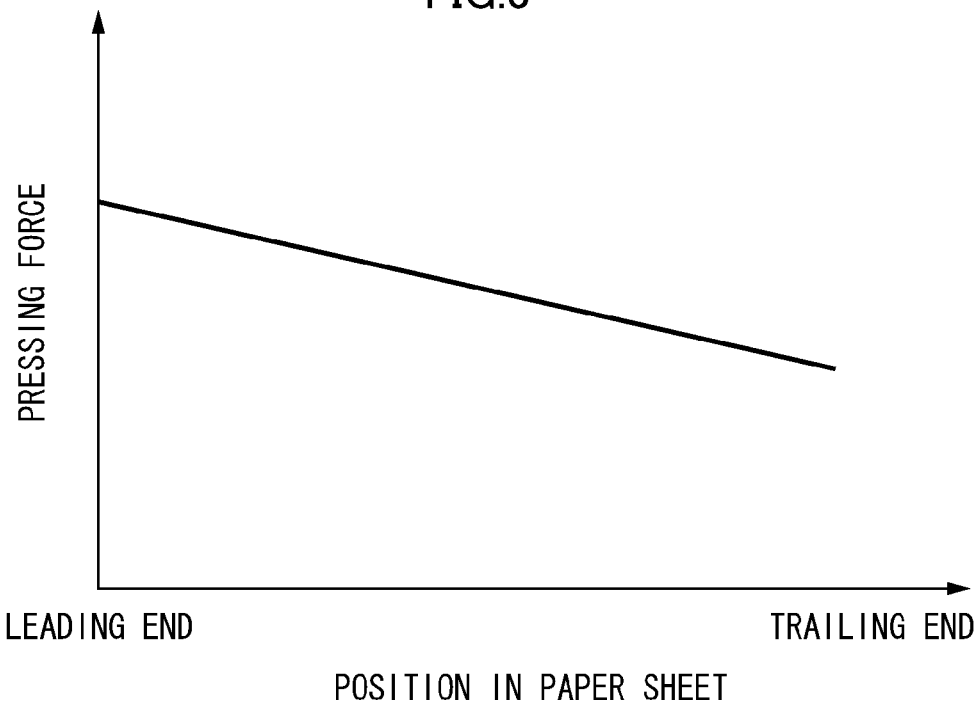
FIG. 3 is a graph showing a relationship between a position in the paper sheet and pressing force.

FIG. 3 is a graph showing the relationship between the position in the sheet of paper and the pressing force. As shown in FIG. 3, the pressing force applied to the paper P from the pressing roller 42 is highest at the leading end of the sheet of paper P in the conveyance direction of the paper P and gradually becomes weaker toward the trailing end.

The pressing force is changed linearly in FIG. 3; however, it is also possible to adopt a composition in which the pressing force is changed curvedly.

Figure 4:
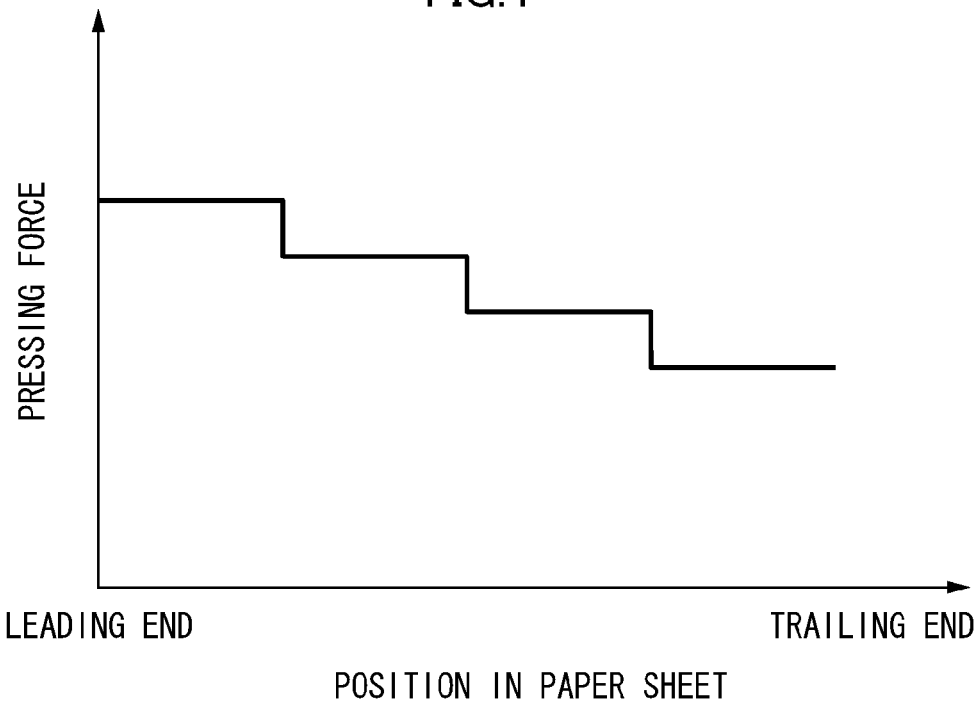
FIG. 4 is a graph showing a relationship between a position in the paper sheet and pressing force.

Furthermore, it is also possible to adopt a composition in which the pressing force applied to the paper P from the pressing roller 42 is changed stepwise as shown in FIG. 4, rather than decreasing smoothly. The pressing force is divided into four levels and decreased stepwise in FIG. 4; however, the number of levels is not limited to this.

Figure 5:
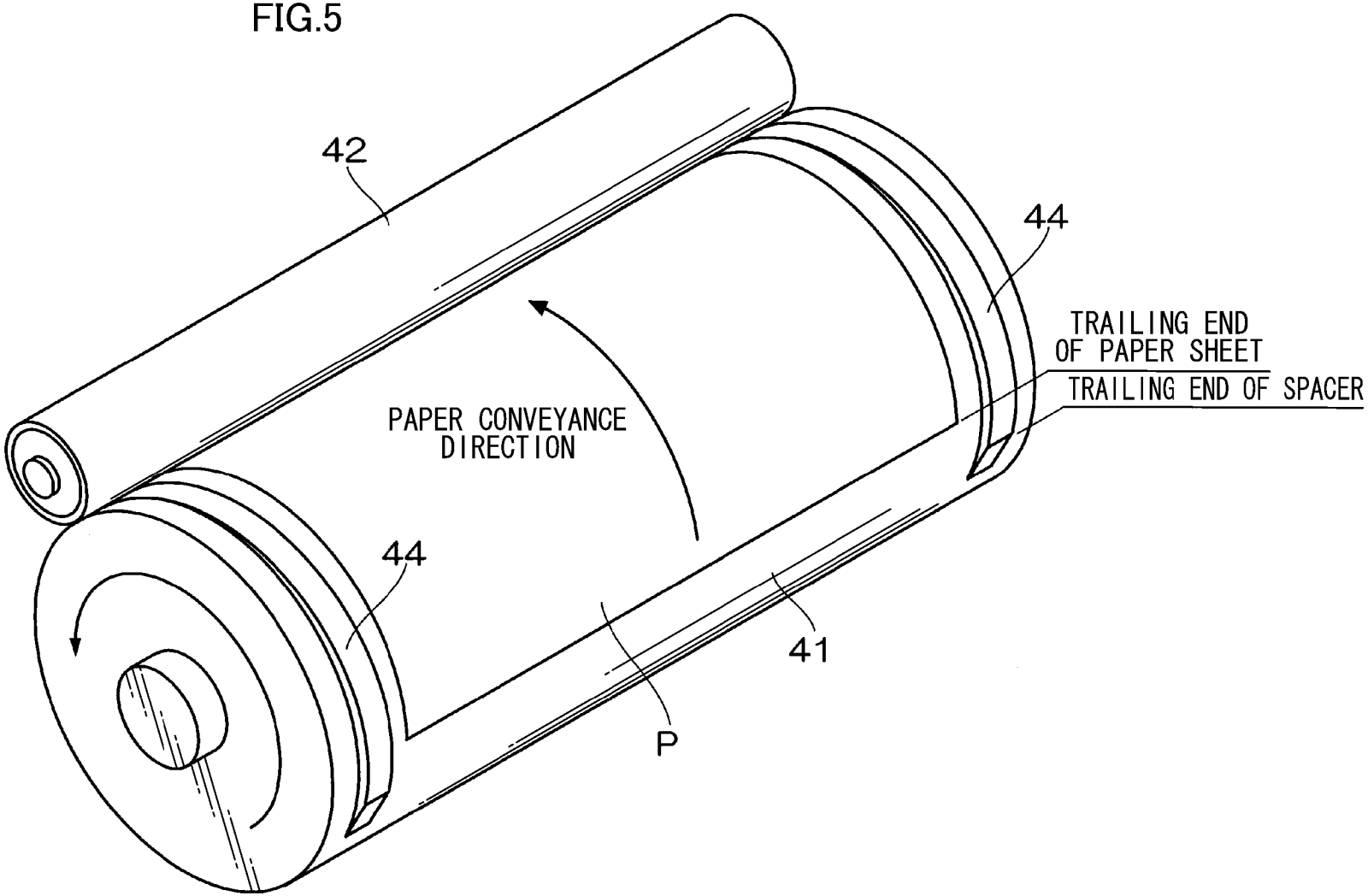
FIG. 5 is a conceptual diagram showing an embodiment of a mechanism that controls the pressing force of a pressing roller.

FIG. 5 is a conceptual diagram showing an embodiment of the mechanism that controls the pressing force of the pressing roller 42.

Figure 6:
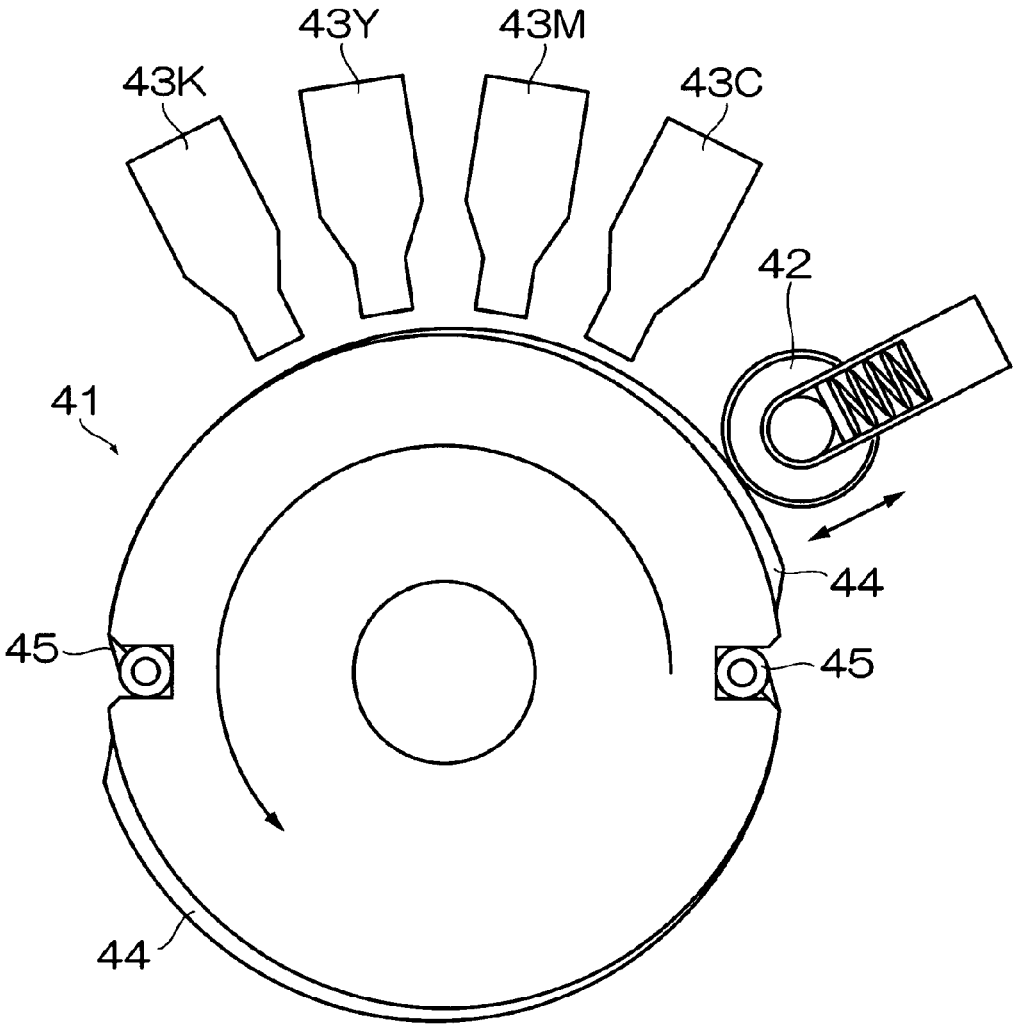
FIG. 6 is a side view diagram showing the embodiment of the mechanism that controls the pressing force of the pressing roller.

As shown in FIG. 5, the pressing force of the pressing roller 42 can be adjusted with spacers 44, which are disposed on the image formation drum 41 in both end portions in the axial direction (the direction perpendicular to the conveyance direction of the paper P) of the image formation drum 41, and have a prescribed shape along the circumferential direction of the image formation drum 41. As shown in FIG. 6, the spacers 44 are formed in such a manner that the height thereof increases continuously from the leading end to the trailing end in the conveyance direction of the paper P.

By arranging the spacers 44 of this kind on the circumferential surface of the image formation drum 41, the pressing roller 42 is gradually separated from the surface of the image formation drum 41 as the image formation drum 41 rotates, and the pressing force of the pressing roller 42 thereby decreases continuously from the leading end to the trailing end of the conveyance direction.

The spacers 44 are disposed so as to correspond to the holding positions of the paper P, and the trailing ends thereof are located behind the trailing ends of the sheets of paper P held by the grippers 45 (the leading end positions of the spacers are not limited in particular and in the present embodiment, the leading end positions of the spacers 44 coincide with the positions of the grippers 45).

Moreover, the spacers 44 are disposed on either side of the holding regions of the paper P set on the image formation drum 41 in such a manner that the holding regions of the paper P are positioned therebetween.

The height of each spacer increases linearly in FIG. 5; however, it is also possible to adopt a composition in which the height increases curvedly. Moreover, it is also possible to adopt a composition in which the height increases stepwise, rather than increasing smoothly. Furthermore, it is desirable that the spacers 44 are removable and can be exchanged depending the type of paper P (thickness, size, material, and so on). Thus, the paper P can be pressed with a suitable pressing force, in accordance with the type of paper P. Hence, it is desirable that a plurality of spacers 44 having different heights, gradients, etc., are prepared.

Figure 7:
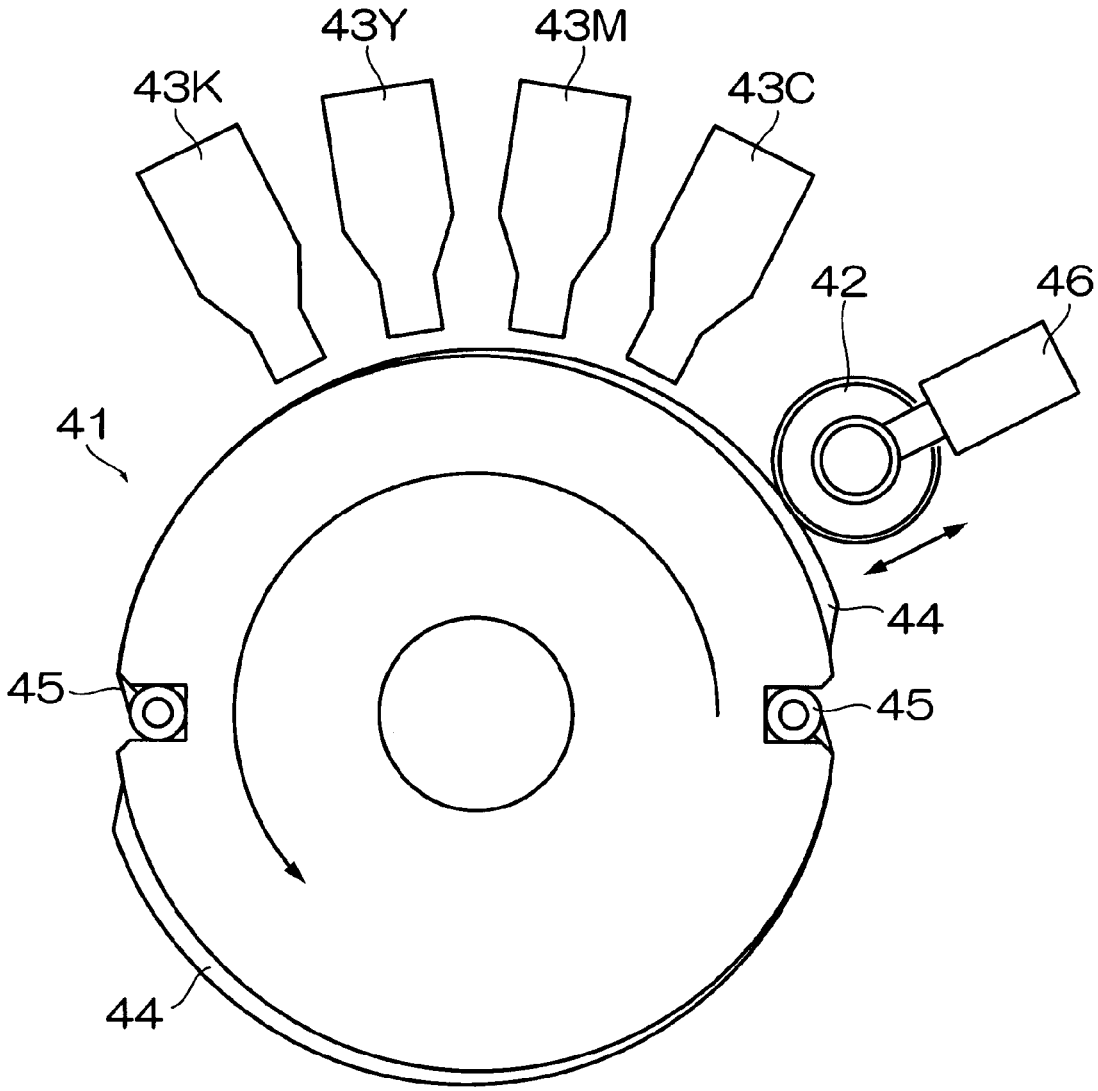
FIG. 7 is a side view diagram showing another embodiment of the mechanism that controls the pressing force of the pressing roller.

In the embodiment described above, the composition is adopted in which the pressing force of the pressing roller 42 is adjusted by arranging the spacers 44 of the prescribed shape on the circumferential surface of the image formation drum 41; however, the composition for controlling the pressing force of the pressing roller 42 is not limited to this. Apart from this, for example, as shown in FIG. 7, it is also possible to adopt a composition where the pressing roller 42 is supported movably forward and backward with respect to the image formation drum 41 by a cylinder 46, and the pressing roller 42 is pressed toward the circumferential surface of the image formation drum 41 by the cylinder 46 while the pressing force of the pressing roller 42 is controlled by controlling the driving of the cylinder 46.

In the present embodiment, the pressing roller 42 having a so-called straight shape is used and the pressing force is uniform over the width direction of the paper P; however, it is also desirable that the pressing force applied by the pressing roller 42 is low in the central portion of the image formation drum 41 and becomes higher toward both ends of the image formation drum 41. By thus making the pressing force applied by the pressing roller 42 lower in the central portion of the image formation drum 41 and higher toward the end portions of the image formation drum 41, it is possible to expel any creases in the paper P toward the ends and therefore the occurrence of creasing can be prevented more effectively.

Figure 8:
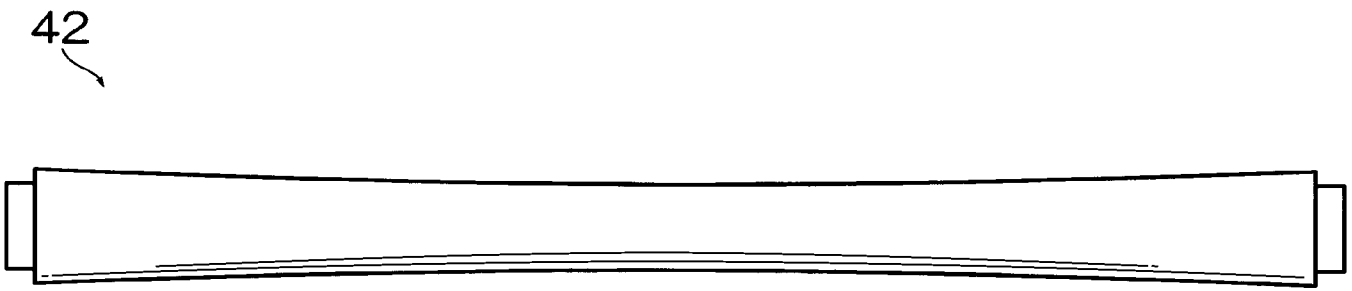
FIG. 8 is a front view diagram of a pressing roller.

A pressure distribution of this kind can be achieved, for example, by using a so-called inverted crown shape (a shape where the diameter is smaller in the central portion and becomes larger toward either end) for the shape of the pressing roller 42, as shown in FIG. 8. Furthermore, it is also possible to achieve a similar pressure distribution by adjusting the elasticity of the member that constitutes the pressing roller 42 so as to be harder in the central portion and become softer toward the ends.

Furthermore, as described above, in the inkjet printer 10 according to the present embodiment, the composition is adopted in which the paper P is held by attraction onto the circumferential surface of the image formation drum 41, and it is desirable that the attractive force used to hold the paper P by attraction onto the image formation drum 41 is controlled in the conveyance direction of the paper P. In other words, as shown in FIG. 9, desirably, the attractive force applied to the paper P is increased over time from the start of pressing by the pressing roller 42.

In the inkjet printer 10 according to the present embodiment, the pressing roller 42 is disposed at a prescribed position and therefore the attractive force is controlled so as to increase over time after the leading end of the sheet of paper P conveyed by the image formation drum 41 has passed the pressing roller 42.

By controlling the attractive force in this way, it is possible to convey the paper P without the occurrence of creasing and floating up. More specifically, if the attractive force applied to the paper P is set to be too strong, then creasing is liable to arise in the trailing end portion of the sheet of paper P in the conveyance direction, and conversely if the attractive force is set to be too weak, then floating is liable to occur in the trailing end portion of the sheet of paper P in the conveyance direction. Therefore, by making the attractive force weak at the start of pressing by the pressing roller 42 and then strengthening the attractive force as pressing progresses, it is possible to convey the paper P without the occurrence of creasing or floating up.

Figure 9:
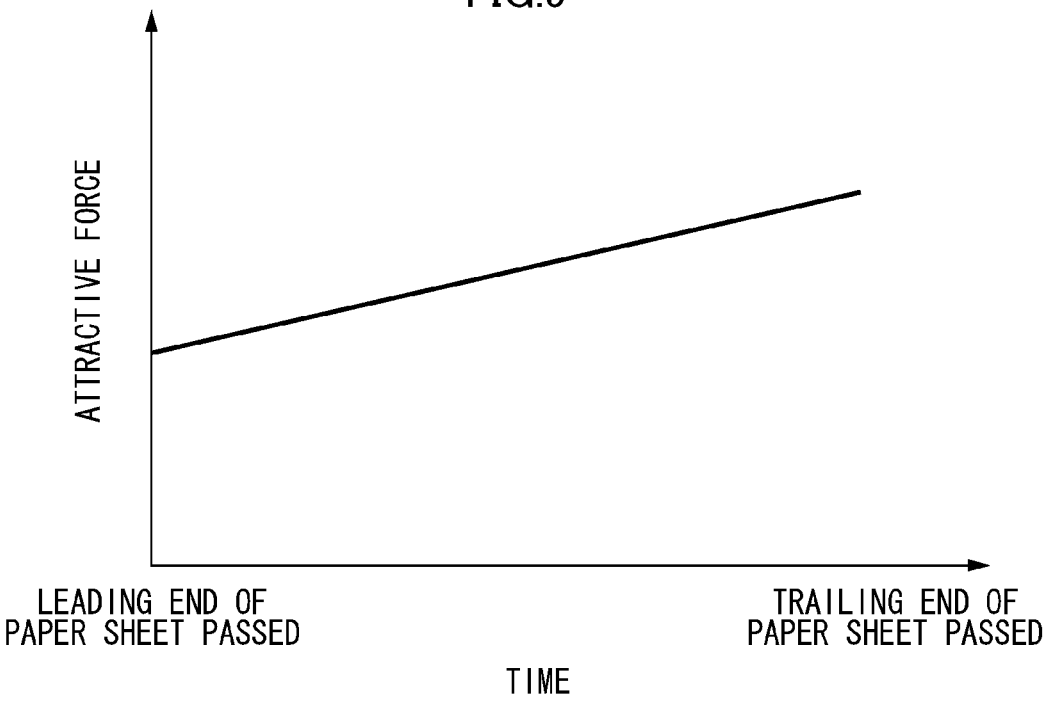
FIG. 9 is a graph showing variation over time of the attractive force applied to the paper.

The attractive force applied to the paper P is changed linearly in FIG. 9; however, it is also possible to adopt a composition in which the attractive force is changed curvedly.

Figure 10:
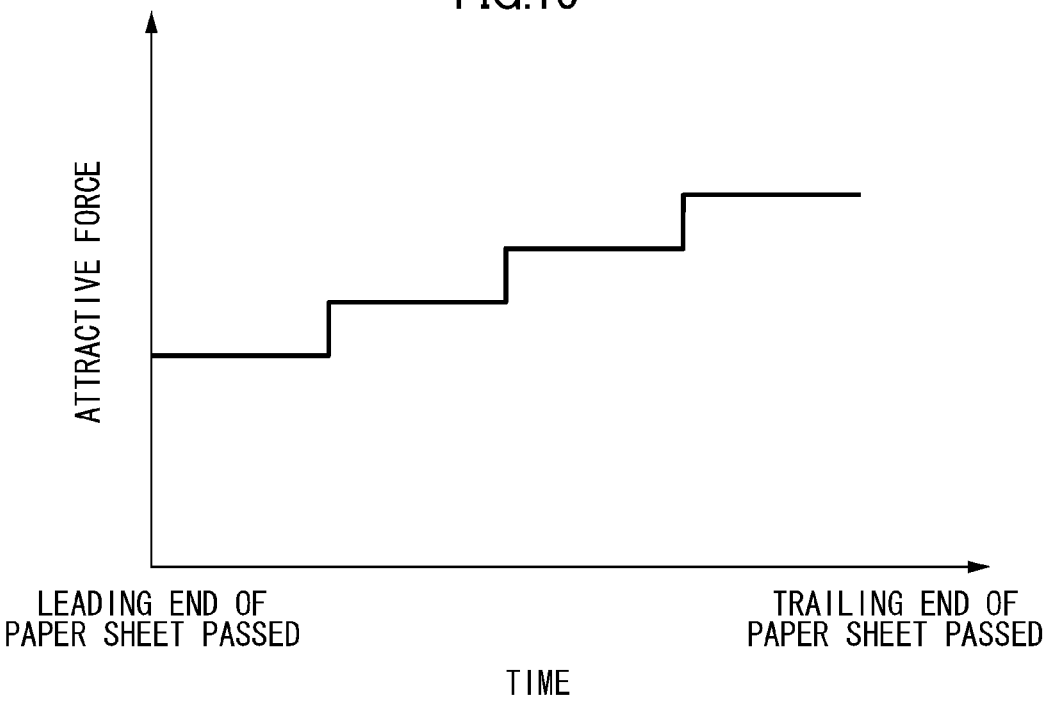
FIG. 10 is a graph showing variation over time of the attractive force applied to the paper.

Furthermore, it is also possible to adopt a composition in which the attractive force applied to the paper P is changed stepwise as shown in FIG. 10, rather than increasing smoothly. The attractive force is divided into four levels and increased stepwise in FIG. 10; however, the number of levels is not limited to this.

In the inkjet printer 10 according to the present embodiment, the composition is adopted in which air is sucked through the suction holes formed in the circumferential surface of the image formation drum 41 and the paper P is thereby held by attraction or suction onto the circumferential surface of the image formation drum 41, and hence the attractive force or suction force is controlled by controlling the driving of the vacuum pump that acts as the negative pressure generating device (for example, the driving is controlled so as to alter the opening ratio of an electromagnetic valve of the vacuum pump, or the like).

If the mechanism for holding the paper P by attraction uses electrostatic attraction instead of suction, then the attractive force can be controlled by controlling the voltage of a corona charger in the electrostatic attraction mechanism, for example.

Figure 11:
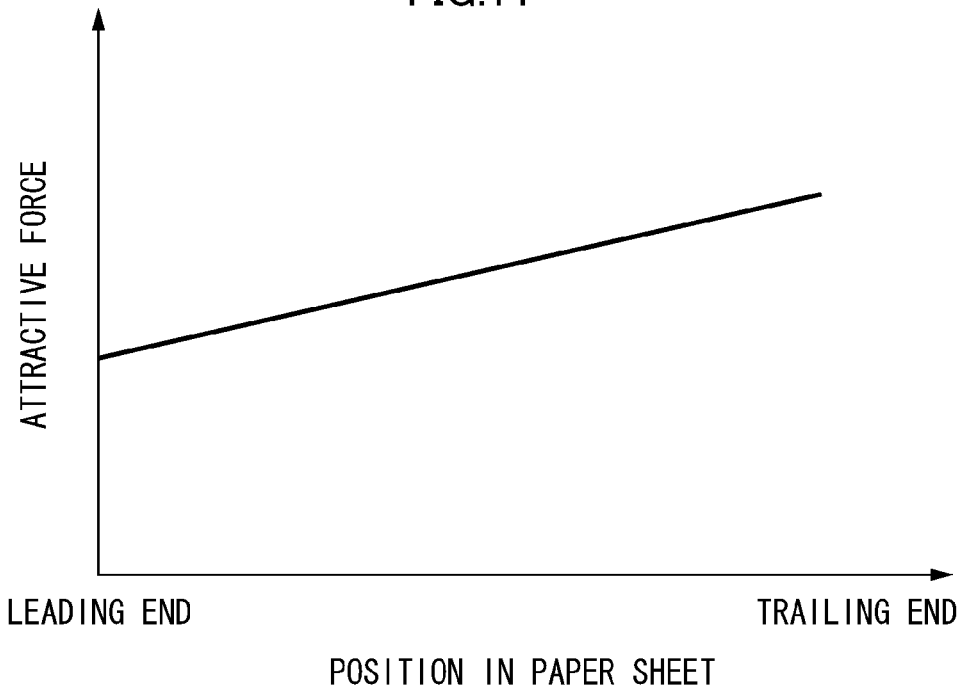
FIG. 11 is a graph showing a relationship between a position in the paper sheet and the attractive force.

Furthermore, in the example described above, the attractive force is changed over time, but it is also possible to obtain similar beneficial effects by changing the attractive force in the direction parallel to the conveyance direction of the paper P. More specifically, as shown in FIG. 11, the attractive force is controlled in such a manner that the attractive force increases in the direction parallel to the conveyance direction of the paper P from the leading end of the sheet of paper P to the trailing end in the conveyance direction of the paper P. Thereby, it is possible to hold the paper P with a suitable attractive force, and the paper P can be conveyed without the occurrence of creases or floating up of the paper P.

Figure 12:
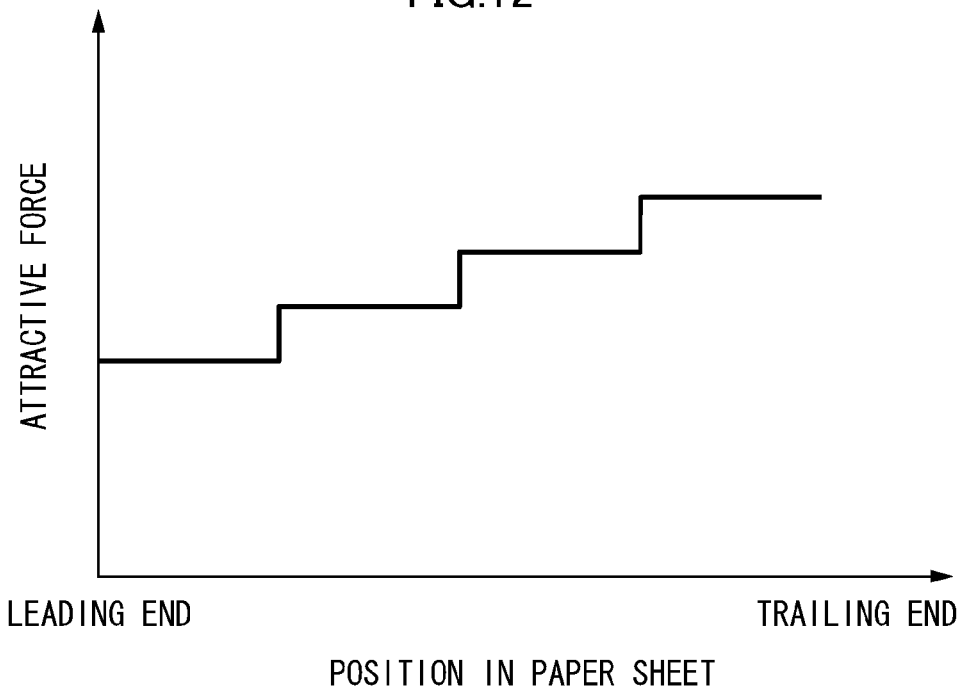
FIG. 12 is a graph showing a relationship between a position in the paper sheet and the attractive force.

In this case also, it is also possible to adopt a composition in which the attractive force is changed curvedly. Moreover, it is also possible to adopt a composition in which the attractive force increases stepwise as shown in FIG. 12, rather than increasing smoothly.

In the composition where the paper P is held by vacuum suction, such control of the attractive force can be achieved, for example, by altering the density of suction holes arranged in the circumferential surface of the image formation drum 41, along the conveyance direction of the paper P. On the other hand, in the composition where the paper P is held by electrostatic attraction, such control of the attractive force can be achieved, for example, by altering the permittivity of the image formation drum 41, along the conveyance direction of the paper P.

As described above, according to the inkjet printer 10 of the present embodiment, it is possible to convey the paper P without the occurrence of creases or floating up, by controlling the pressing force of the pressing roller 42 that causes the paper P to make close contact with the image formation drum 41. Thus, it is possible to stably print images of high quality.

In the above-described embodiments, the present invention is applied to the image forming apparatus having the composition where paper is conveyed by the drums; however, the present invention can also be applied similarly to an image forming apparatus having a composition where paper is conveyed by a belt, and similar action and beneficial effects can be achieved in this case.

Figure 13:
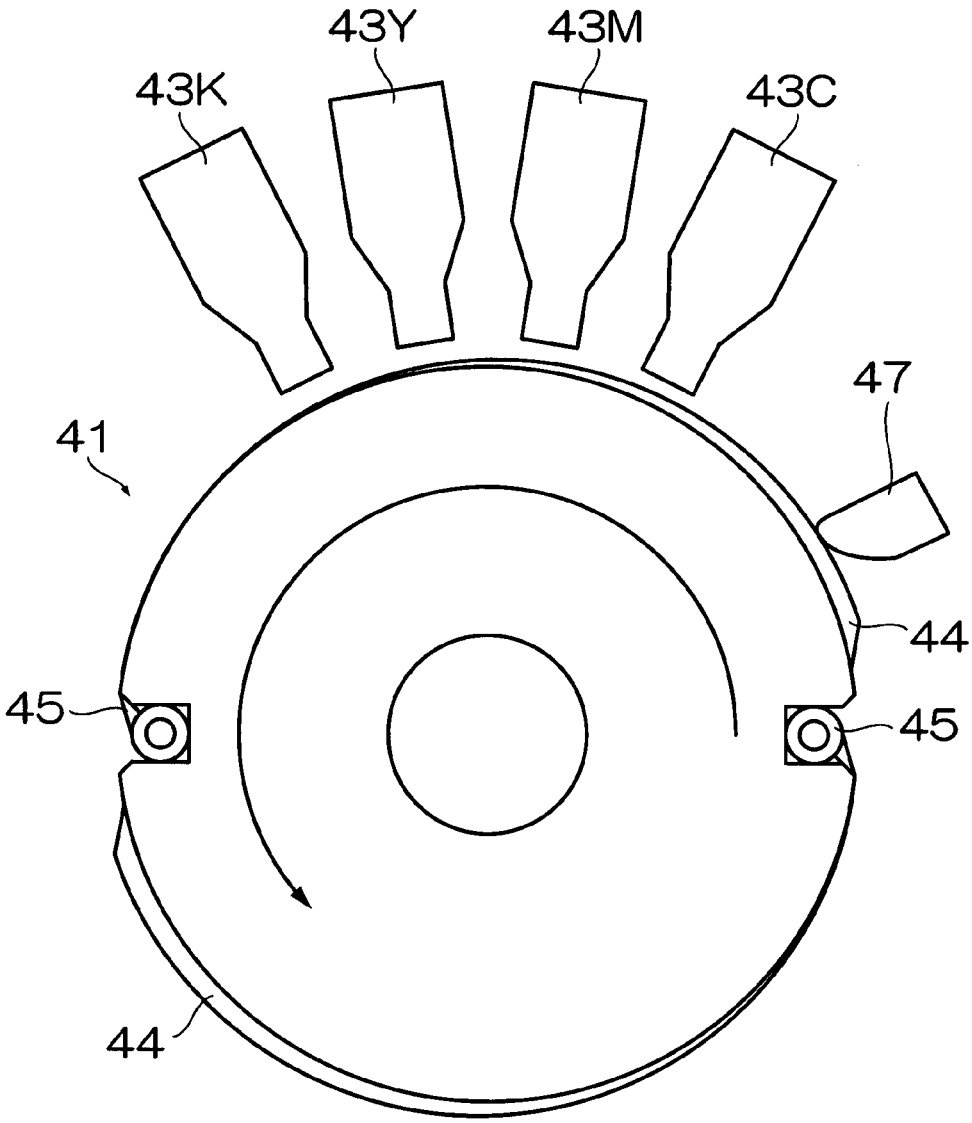
FIG. 13 is side view diagram showing another embodiment of the pressing member.

In the above-described embodiments, the pressing roller is used as the pressing member which presses the paper; however, the pressing member which presses the paper is not limited to this. Apart from this, for example, it is also possible to adopt a composition in which, as shown in FIG. 13, a pressing plate 47 is disposed so as to apply pressure toward the circumferential surface of the image formation drum 41, in such a manner that the surface of the paper P is pressed by the pressing plate 47 and caused to make close contact with the circumferential surface of the image formation drum 41. The pressing plate 47 is constituted of a plate-shaped member having the width (the dimension in the direction perpendicular to the conveyance direction of the paper P) corresponding to the width of the image formation drum 41, and the pressing portion thereof (the portion that abuts against the paper P) is covered with rubber. Even in cases where the paper P is pressed by the pressing plate 47 of this kind, the paper P can be conveyed without the occurrence of creases or floating by applying the present invention.

In the above-described embodiments, the present invention is applied to the image forming apparatus having the composition where ink droplets are ejected and deposited after previously depositing the prescribed treatment liquid; however, the application of the present invention is not limited to this and the present invention can also be applied similarly to an image forming apparatus having a composition in which no treatment liquid is deposited previously. In an image forming apparatus in which droplets of ink are ejected and deposited after previously depositing treatment liquid, as in the inkjet printer according to the above-described embodiments, there are cases where the paper deforms (suffers cockling, or the like) due to the deposition of the treatment liquid, and therefore by applying the present invention, it is possible to prevent the occurrence of creases or floating up of the paper more effectively. Similarly, in the case of double-side printing, deformation may occur in the paper after printing on one side, and therefore by applying the present invention, it is possible to prevent the occurrence of creases or floating up of the paper more effectively.

In the above-described embodiments, printing is performed onto cut sheets of coated paper; however, there are no particular restrictions on the type of recording medium. Deformation of the recording medium is prominent mainly when using ink having a water solvent (i.e., aqueous ink) to print on ordinary coated printing paper or normal paper (recording media which are not special inkjet paper), and therefore by applying the present invention to apparatuses which print under these conditions, it is possible to prevent the occurrence of creases and floating up of the recording media more effectively.

In the above-described embodiments, the pressing roller is disposed around the conveyance drum of the image formation unit only; however, it is also possible to similarly arrange pressing rollers around the conveyance drums in the other units. In order to achieve high-quality printing, it is necessary to keep the distance in the image formation unit from the surface of the paper to the inkjet heads (the throw distance) to a prescribed distance or less (approximately 1 mm or less), and by conveying the paper by using the conveyance method according to the present invention, it is possible to perform stable conveyance even if the throw distance is short.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A recording medium conveyance method of conveying a cut sheet of a recording medium, the method comprising the steps of:

wrapping the cut sheet about a circumferential surface of a conveyance body and conveying the cut sheet in a conveyance direction by rotating the conveyance body, the conveyance body being one of a drum and a belt, a back surface of the cut sheet being in contact with the circumferential surface of the conveyance body; and pressing a pressing member to a front surface of the cut sheet held on the circumferential surface of the conveyance body, to apply pressing force to the cut sheet to make the cut sheet close contact with the circumferential surface of the conveyance body, while controlling the pressing force so as to gradually decrease the pressing force from a leading end of the cut sheet toward a trailing end of the cut sheet in terms of the conveyance direction, wherein the leading end of the cut sheet is gripped by a gripper provided at the conveyance body.

2. The recording medium conveyance method as defined in claim 1, wherein the holding step includes the step of applying attractive force to attract the back surface of the cut sheet to the circumferential surface of the conveyance body.

3. The recording medium conveyance method as defined in claim 2, wherein the attractive force is controlled so as to increase the attractive force over time from a start of the pressing by the pressing member.

4. The recording medium conveyance method as defined in claim 2, wherein the attractive force is controlled so as to increase the attractive force from the leading end of the cut sheet toward the trailing end of the cut sheet.

5. The recording medium conveyance method as defined in claim 1, wherein the pressing member applies the pressing force increasing from a center of the cut sheet toward each widthwise end of the cut sheet in a direction perpendicular to the conveyance direction.

6. The recording medium conveyance method as defined in claim 1, wherein the pressing force is set in accordance with a type of the recording medium.

7. A recording medium conveyance apparatus, comprising:

a conveyance device which grips a leading end of a cut sheet of a recording medium by a gripper provided at a conveyance body and wraps the cut sheet about a circumferential surface of the conveyance body and conveys the cut sheet in a conveyance direction by rotating the conveyance body, the conveyance body being one of a drum and a belt, a back surface of the cut sheet being in contact with the circumferential surface of the conveyance body;

a pressing device which presses a pressing member to a front surface of the cut sheet held on the circumferential surface of the conveyance body, to apply pressing force to the cut sheet to make the cut sheet close contact with the circumferential surface of the conveyance body; and a pressing force control device which controls the pressing force so as to gradually decrease the pressing force from a leading end of the cut sheet toward a trailing end of the cut sheet in terms of the conveyance direction.

8. The recording medium conveyance apparatus as defined in claim 7, wherein the conveyance device includes an attraction device which applies attractive force to attract the back surface of the cut sheet to the circumferential surface of the conveyance body.

9. The recording medium conveyance apparatus as defined in claim 8, further comprising an attractive force control device which controls the attractive force so as to increase the attractive force over time from a start of the pressing member to press the front surface of the cut sheet.

10. The recording medium conveyance apparatus as defined in claim 8, further comprising an attractive force control device which controls the attractive force so as to increase the attractive force from the leading end of the cut sheet toward the trailing end of the cut sheet.

11. The recording medium conveyance apparatus as defined claim 7, wherein the pressing member applies the pressing force increasing from a center of the cut sheet toward each widthwise end of the cut sheet in a direction perpendicular to the conveyance direction.

12. The recording medium conveyance apparatus as defined in claim 7, wherein the pressing force control device includes spacer members which are arranged at both widthwise ends of the conveyance body along a circumferential direction of the conveyance body, each of the spacer members having height from the circumferential surface of the conveyance body increasing from a position corresponding to the leading end of the cut sheet toward a position corresponding to the trailing end of the cut sheet.

13. The recording medium conveyance apparatus as defined in claim 12, wherein the spacer members are arranged to the conveyance body exchangeably in accordance with a type of the recording medium, so as to set the pressing force in accordance with the type of the recording medium.

14. The recording medium conveyance apparatus as defined in claim 7, wherein the pressing member includes a roller which is pressed toward the circumferential surface of the conveyance body.

15. An image forming apparatus, comprising:

the recording medium conveyance apparatus as defined in claim 7; and a droplet ejection device which ejects droplets of liquid to the recording medium conveyed by the recording medium conveyance apparatus.

16. The image forming apparatus as defined in claim 15, further comprising a treatment liquid deposition device which deposits treatment liquid onto the recording medium, wherein the recording medium on which the treatment liquid has been deposited by the treatment liquid deposition device is conveyed by the recording medium conveyance device.

* * * * *